United States Patent [19]

Bannister

[11] 4,443,911

[45] Apr. 24, 1984

[54] DEVICE FOR INTERCONNECTING PANELS

[75] Inventor: Brian C. Bannister, North Mimms, England

[73] Assignee: Marler Haley Exposystems Limited, Hertfordshire, England

[21] Appl. No.: 444,175

[22] Filed: Nov. 24, 1982

[51] Int. Cl.[3] ..... E05D 3/06; E04B 1/344; A47G 5/00

[52] U.S. Cl. ..... 16/354; 160/135; 52/239

[58] Field of Search ..... 160/135; 52/239; 16/354, 386

[56] References Cited

U.S. PATENT DOCUMENTS

| | | | |
|---|---|---|---|
| 3,284,842 | 11/1966 | Jennings | 16/386 |
| 4,056,985 | 11/1977 | Worrallo | 16/354 |

FOREIGN PATENT DOCUMENTS

| | | | |
|---|---|---|---|
| 58318 | 11/1967 | Australia . | |
| 101 | of 1885 | United Kingdom | 16/354 |
| 1146572 | 3/1969 | United Kingdom . | |
| 1536951 | 12/1978 | United Kingdom . | |
| 1542244 | 3/1979 | United Kingdom . | |

*Primary Examiner*—James L. Ridgill, Jr.

*Attorney, Agent, or Firm*—Banner, Birch, McKie & Beckett

[57] ABSTRACT

An adjustable structure comprises two panels 24 carrying at adjacent edges respective members 11, 13, each having ribs 14 and grooves inter-engaging with one another after the fashion of gear teeth so that the members 11, 13, can roll relative to one another about respective axes parallel with the panel edges. Each member 11, 13, carries within a respective longitudinal passage 33 resilient spindle elements 35 disposed substantially coaxially with the member 11, 13, and resiliently displaceable, at least in part, transversely of said axis. The members 35 are held together by connecting links 46 providing hooks receiving respective resilient spindle elements 35 of the two members, slots 32 being formed in the members 11, 13, for passage of the links. The configuration of the links 46 and the spindle elements 35 is such that resilient displacement of spindle elements 35 transversely of their axes, towards one another, is necessary to apply the links to or detach the links from the spindle elements. The construction described allows quick and simple assembly of various adjustable structures incorporating such panels, while ensuring reliable interconnection of the panels and adjustment of the structure.

7 Claims, 8 Drawing Figures

DEVICE FOR INTERCONNECTING PANELS

SUMMARY OF THE INVENTION

A structure of this general type is known, for example from our British Patent Specification No. 1,542,244 which discloses a structure in the form of a series of hingedly interconnected panels intended as a temporary display structure for exhibition and the like purposes.

It is an object of the present invention to provide an improved adjustable structure incorporating members having ribs and grooves interengaging with one another after the fashion of gear teeth.

According to the invention there is provided an adjustable structure comprising two members each having ribs and grooves interengaging with one another after the fashion of gear teeth so that the members can roll relative to one another about respective axes, each said member carrying a resilient spindle element disposed substantially coaxially with the respective said member and resiliently displaceable, at least in part, transversely of said axis, said members being held together by at least one connecting element providing openings or recesses receiving respective said resilient spindle elements of the two members, the configuration of the connecting element and/or the spindle elements being such that resilient displacement of said spindle elements transversely of said axes, towards one another is necessary to apply the connecting element to or detach it from said spindle elements.

BRIEF DESCRIPTION OF THE DRAWINGS

An embodiment of the invention is described below by way of example with reference to the accompanying drawings in which.

DESCRIPTION OF THE PREFERRED EMBODIMENTS

The drawings relate to systems of hingedly interconnected panels, for use in temporary exhibition displays and the like, in which the connection between adjoining edges of adjoining panels is effected by means of gear-like members secured to the respective edges of the respective panels and meshing with one another, so that the panels are connected together in such a manner as to allow smooth controlled adjustment movements to be effected between panels; and so that the panels may be folded together accordian fashion, etc. The general arrangement of interconnected panels and adjustment of the panels relative to one another is substantially the same as that described in our British Patent Specification No. 1,542,244 to which reference should be had.

Figure 1:
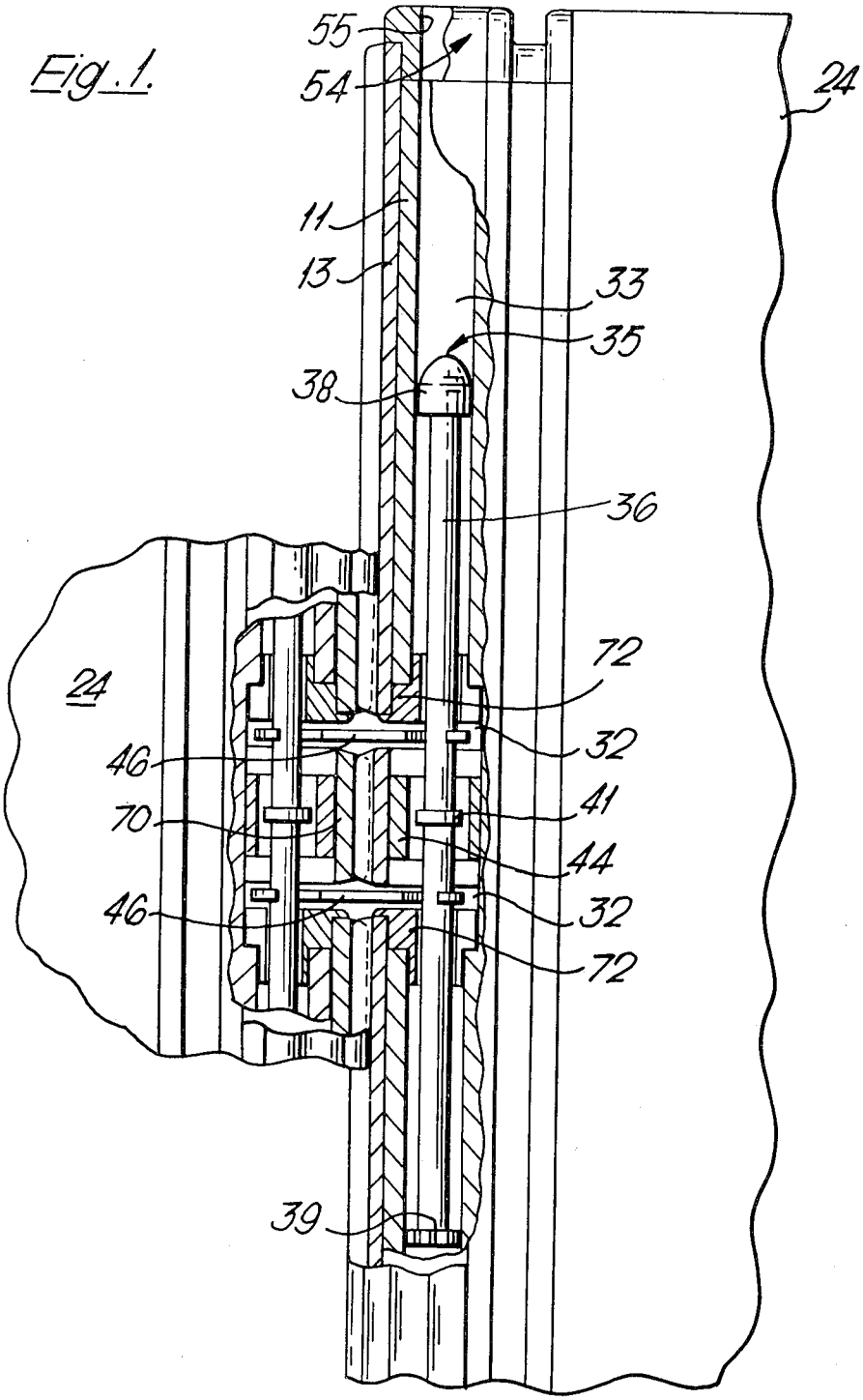
FIG. 1 is a partial axial section view illustrating the assembly provided at one edge of one panel of a series of hingedly interconnected panels of a structure embodying the invention.
Figure 2:
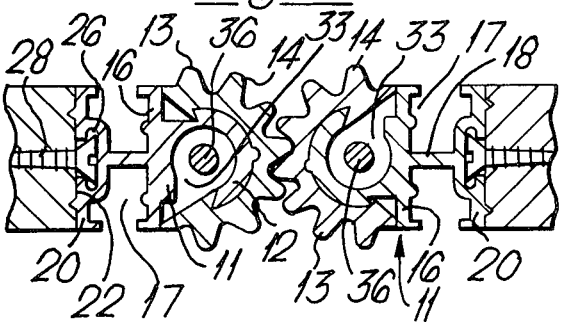
FIG. 2 is a view in cross-section of part of the assembly.

In the system to which the FIGS. 1 to 4 relate, the gear-like members secured to the adjoining edges of adjoining panels are of composite form each comprising a member 11 consisting of a length cut from an extrusion of the uniform cross section discernable from FIG. 2, which extrusion may be an extrusion in aluminium alloy and fitted to member 11, cladding members 13, e.g. of plastics, of the cross-section shown. The extrusion which affords each member 11 comprises a part 12 which has the approximate form of a capital "D" with one of the two "corners" removed to provide a longitudinally extending slot along the section, which facilitates the manufacture, by extrusion, of the member 11, said slot communicating with the central passage 33 along the part 12 and which passage, but for said slot, is cylindrical in section. The part or portion 12 corresponding to the straight part of the "D" adjoins, and is integral with, a web 16, of greater transverse width than portion 12 and which thus projects beyond portion 12 on either side. The web 16 is connected via a perpendicular central web 18 with an attachment part, indicated generally at 20, which provides a flat rear face, parallel with the web 16, which is secured to the planar edge face 22 of the respective panel 24.

The part 20 is formed with a generally T-shaped longitudinal channel which opens in a longitudinal central slot 26 on the rear face of part 20 and the part 20 is secured to the panel 24 by screws 28 the heads of which are held captive in the wider part of the T-section channel and the shanks of which pass through the slot 26 into the edge face 22 of the panel. In assembly (see FIG. 5), when the member 11 is applied to the edge of the panel 24, the heads of the screws 28 pass through circular enlargements 30 formed at predetermined positions along the slot 26, to enter the T-section channel, and the member 11 is then displaced longitudinally into its final position, so that the enlargements 30 are moved out of register with the heads of the screws 28 and the screw's heads are held captive in the T-shaped channel. The manner of attachment is thus analogous to a "key-hole slot" arrangement.

Between the attachment part 20 and the part 12, on either side of the central web 18, are defined respective longitudinally extending channels 17, opening onto the sides of the member 11 via respective longitudinally extending slots bounded by inturned flanges of said channels, so that said slots are reduced width compared with said channels 17, whereby ancilliary fittings, not shown, may be fitted to the panel by means of portions held captive in said channels 17.

Extended filler strips, not shown, may cover the channels 17 when these are not required.

As discussed in greater detail below, each cladding member 13 affords longitudinally extending ribs 14, which form the gear teeth and between which are defined the grooves which receive the gear teeth of the co-operating cladding member.

Figure 4:
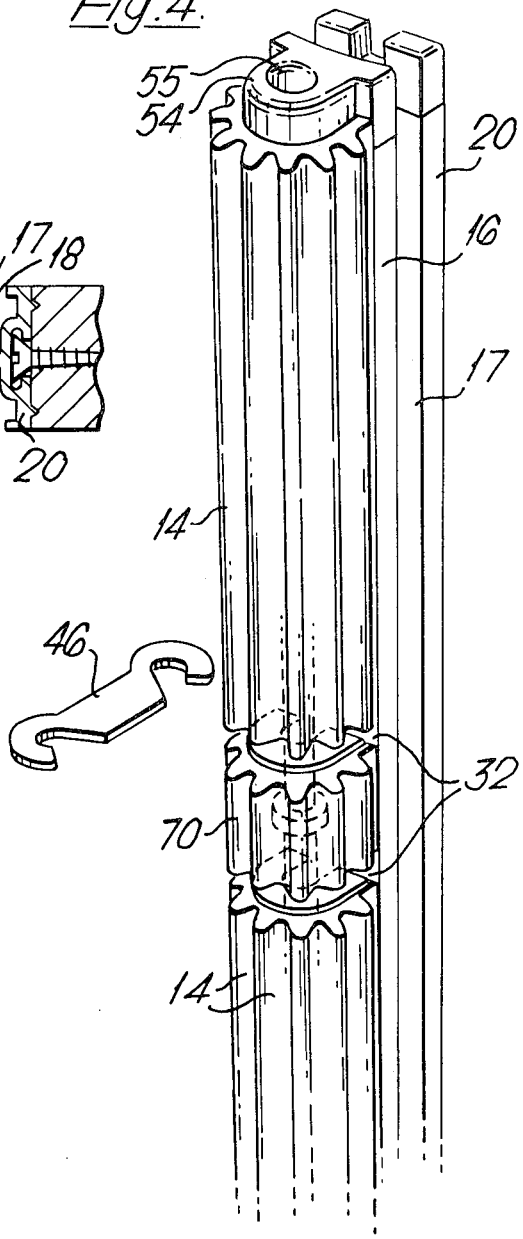
FIG. 4 is a perspective view of part of the structure of FIG. 1.

At intervals along each gear like member, as shown in FIGS. 1 and 4 the part 12 is cut away, as far back as the web 16, and the cladding 13 omitted to afford slots 32, the upper and lower edges of which are substantially perpendicular to the longitudinal axis of the member 11.

Located within the central passage 33 (FIG. 2) in each member 11 are a plurality of spindle elements, of the form shown in side elevation at 35 in FIG. 1, and each comprising a resilient steel rod 36, fitted at one end with a resilient plastics cap 38 and fitted at its other end with a metal disc 39 with a "milled" periphery affording longitudinally extending grooves beteen which teeth are defined, the rod 36 being provided midway between its ends with a tubular plastics spacer 41. Each cap 38 is dimensioned to fit closely within passage 33, when the element 34 is fitted within the passage 33 whilst the disc 39 is so formed and dimensioned, with a slight taper towards the cap 38, that it is slightly oversize in relation to the passage 33 and must be driven forcibly into position along the passage 33 while the teeth thereon bite into the wall of the passage to hold the disc 39, and thus the rod 36, in place. The slots 32 are formed in pairs, with the axial spacing between the slots of a pair being greater than the axial length of the spacer 41 and each element 35 is disposed with its spacer 41 located within a respective portion 44 of the member 11 lying between the two slots 32 of a respective said pair.

The external diameter of the spacers 41 is somewhat less than that of the caps 38, so that the spacers 41 have a predetermined transverse clearance in the passage 33.

Figure 3A:
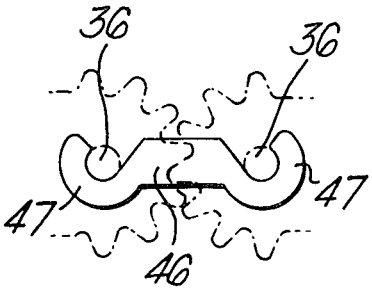
FIG. 3A and FIG. 3B are schematic views, in a direction parallel with the axes of the hinged connection between two adjoining panels in the system to which the structure of FIGS. 1 and 2 belongs.
Figure 3B:
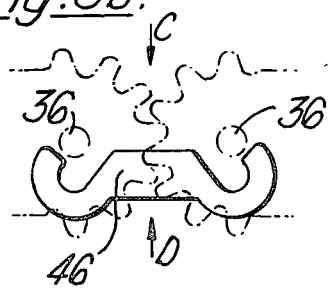

As best shown schematically in FIGS. 3A and 3B, the adjoining members 11, 13 of two adjoining panels are held together with their longitudinal axes parallel and the "teeth" or ribs 14 of the cladding members in mesh, by means of a plurality of connecting links 46 each passing through a respective slot 32 in one member 11, 13 to engage an element 34 in that member and also passing through an aligned slot 32 in the other member 11, 13 to engage a corresponding element 34 in said other member 11, 13. Each connecting link 46 is in the form of a plate or bar having parallel upper and lower faces and affording at either end thereof a respective hook formation 47 which engages around the rod 36 of the respective element 34. As shown in FIGS. 3A and 3B, each hook formation 47 has a free end which extends further, in the direction towards the other hook formation 47 than the deepest part of the recess formed within the bend of the hook formation, and the arrangement is such that the inherent resilience of the rods 36 engaged by each link 46 urges the rods 36 apart to a spacing which is greater than the spacing between the closest part of the free ends of the two hook formations of the link. The surfaces of the hook formations 47 in the region of the parts of the free ends of the hook formations which are closest to one another are formed as cam surfaces, so that any link 46 may be removed simply by pushing it, in the direction indicated by the arrow C in FIG. 3B, so that by the camming action between the hook formation 47 and the rods 36 the latter are urged resiliently towards one another to the extent necessary to allow the rods 36 to pass from the connecting link. Conversely, the link can be re-fitted simply by pushing it into the aligned slots 32 in the direction indicated by the arrow D in FIG. 3B so that the camming surfaces on the free ends of the hook formations 47 urge the rods 36 together resiliently sufficiently to allow the rods to enter the recesses within the hook formations 47. The amount of transverse flexing which the rods 36 may undergo is limited by engagement of the spacers 41 with the walls of the passages 33.

The cladding of a member 11 above and below a respective pair of slots 32 is formed by respective lengths of an extrusion of the cross-section shown, which is in the form of a generally channel-shaped body which has, externally, the desired geared profile and has, internally, formations to cooperate with corresponding external formations on portion 12, including a median groove to receive a median locating rib on the portion 12 and respective saw-tooth section formations adjacent the edges of the channel, for engagement behind an abutment provided by one edge of the longitudinal slot in portion 12 and behind an abutment provided, on the opposite side of the portion 12, by a saw-tooth section formation on portion 12, so that the cladding 13 may be snap-fitted on portion 12 to be thereafter retained thereon.

The cladding of member 11 between the two slots of one such pair of slots, however, is formed as an injection-moulded plastics member 70 which has, intermediate its upper and lower ends the same cross-sectional shape as the extruded cladding, but has its upper and lower ends formed to provide formations extending across the ends of the respective section of portion 12 between the slots, to conceal said ends and yet afford a passage for the rod 36 (see FIG. 1). The adjoining ends of the portion 12 above and below the respective pair of slots, i.e. the ends which face the member 70, are covered by end plugs 72, of arcuate form, fitted in the passage 33 and having flanges extending over the respective ends of the portion 12 and the extruded cladding.

Each link is thus located at each end between a member 70 and an adjoining end plug 72.

Figure 7:
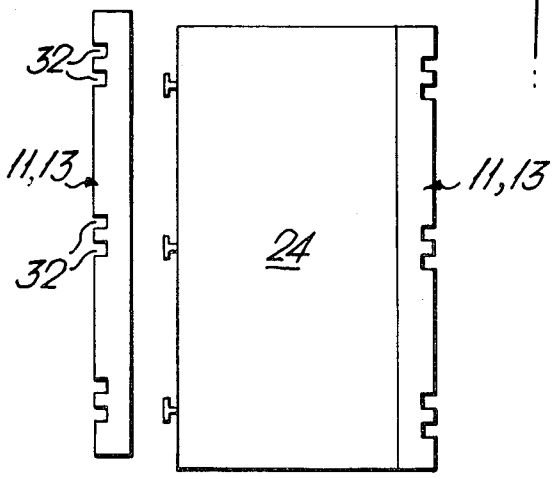
FIG. 7 is a schematic side elevation view illustrating the attachment, to the edges of a panel, of the associated edge structure.

At the upper and lower ends of each member 11, 13, a respective further plastics insert 54 may be provided of the form shown in FIGS. 1 and 2 and comprising a cap for the respective end of the portion 12 and a cover for the respective end of the part 20, with, on its underside, projections for engagement in the passage 33 and the T-shaped channel. The insert 54 has a central aperture 55 aligned with the central passage 33, through which, for example, a supporting rod (not shown) of an ancillary fitting may be extended or through which an electrical flex may be extended. As indicated in FIG. 7, each panel may have, spaced apart along the axial length of each of the two members 11, 13, secured to respective opposite longitudinal edges of the panel, three pairs of slots 32, each pair of slots 32 having associated therewith a respective element 35 accommodated within the respective member 11, 13, with each panel being connected with the adjoining panel, (i.e. each member 11, 13, with the adjoining member 11, 13), by three pairs of connecting links 46, each connecting link 46 being engaged in a respective slot 32 of one member 10 and the aligned slots 32 of the adjoining, meshing member 11, 13.

It will be appreciated that the axes of the rods 36 inserted in the passage 33 of any one member 11 are preferably substantially coincident with the axis of the pitch circle of the "gear-segment" defined by the corresponding members 13, so that the panels may be readily and smoothly pivoted relative to one another as desired.

The resilience of the rods 36 of course permits slight resilient relative transverse displacement between meshing members 13, which thus compensates for inaccuracies of the gear form of the ribs 14.

An advantage which is afforded by disposing the slots 32 in pairs is that this also makes it possible, if desired, to connect first and second gear members 11, 13, at the edges of respective panels with a third gear member 11, 13, at the edge of a further panel, with the third gear member meshing with both the second and third gear members 11, 13, and one slot of each pair of slots 32 in the third gear member being occupied by a link 46 connecting the third gear member with the first gear member 11, 13, and with the other slot in the third gear member being occupied by a link 46 connecting the third gear member 11, 13, with the second gear member 11, 13. The first or second gear member might likewise be connected with a yet further, meshing gear member 11, 13, and so on, so that, for example structures in which a plurality of panels radiate from a common junction region may be readily constructed.

Figure 5:
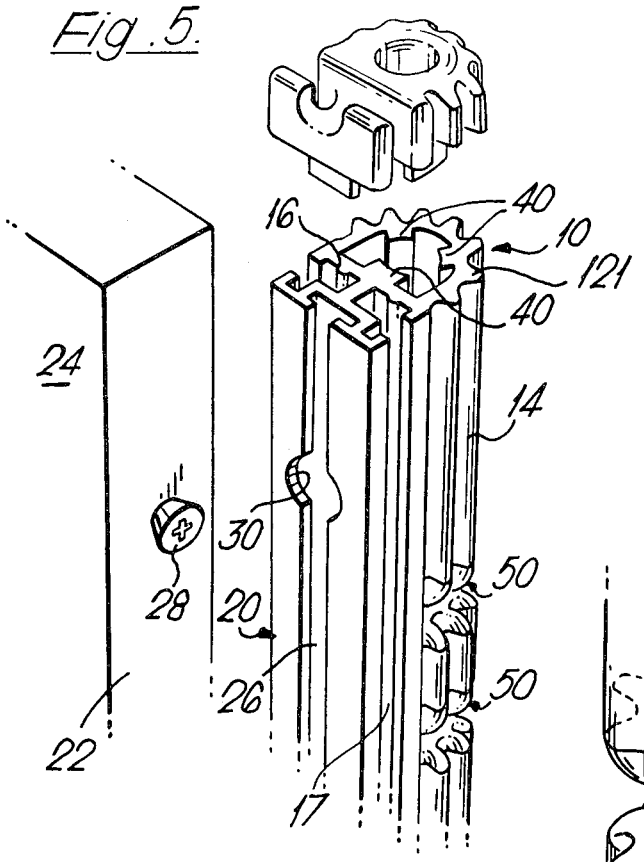
FIG. 5 is a fragmentary exploded perspective view illustrating the assembly provided at one edge of one panel of a series of hingedly interconnected panels of another structure embodying the invention.

If desired, instead of the ribs or teeth 14 being formed by a cladding member formed separately from the aluminium extrusion 11, the ribs or teeth 14 may be formed integrally with the remainder of the aluminium extrusion. Thus, as shown in FIG. 5, in which parts corresponding to parts in FIGS. 1 to 4 have the same references, the gear-like members, indicated at 10 in FIG. 5, secured to the adjoining edges of adjoining panels may be formed by lengths cut from an extrusion, e.g. of aluminium alloy, of the uniform cross-section discernable from FIG. 5. The extrusion affording member 10 corresponds, in cross-sectional shape to that affording member 11, except that in place of the portion 12 an arcuate portion 121 is provided, of larger radius than portion 12 and which extends from one edge of web 16 to the other, the web 16 thus forming the back of an enlarged "D". The portion 121 is provided externally with the longitudinally extending ribs 14, which form the gear teeth and between which are defined the grooves which receive the gear teeth of the co-operating member 10. The extrusion from which member 10 is cut, may, if desired, be plastics coated.

Figure 6:
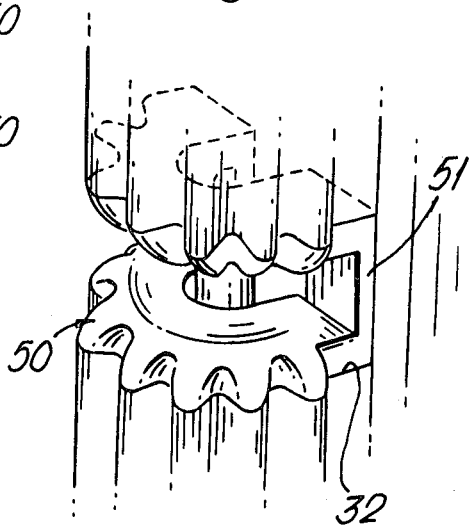
FIG. 6 is a perspective view of a detail of the structure of FIG. 5.

In the member 10, within the "D" there are provided three internal longitudinal ribs 40, the innermost surfaces of which form respective parts of the surface of a common imaginary longitudinal cylindrical bore of about the same diameter as the central passage in portion 12 in FIGS. 1 to 4, these ribs serving to locate the cap and serrated disc. In the arrangement of FIG. 5, the slots 32 are formed by cutting the portion 121 back to the web 16 and, in order to finish or conceal the edges of the portions 121 on either side of each slot, and to provide locating and bearing surfaces for the links, each slot 32 is fitted with a plastics insert 50 comprising two horseshoe-shaped pieces connected to one another, at the free ends of their limbs, by respective flexible plastics webs 51. Each horseshoe-shaped piece has, on its side remote from the other piece, a flat abutment face for engagement with the respective edge face of the respective slot 32 and has, upstanding from this flat abutment face, one or more projections for engagement with the interior of the arcuate wall of the part 12. The insert 50, by reason of the flexibility of the plastics material, may be temporarily deformed to allow the insert to be inserted in the respective slots 32 and the projections on the abutment faces engaged with the interior of the passage 33, so that the insert effectively affords a lining for the upper and lower edges of the slot. Such an insert 50 is shown already fitted in a slot 32 in FIG. 6. With the insert fitted, the free width of the slot corresponds to the separation between the opposing pieces of the insert and is slightly greater than the thickness of the connecting link 46. The two pieces of each insert 50 are provided, on their convex outer edges with teeth which, when the inserts are fitted, form extensions of the ribs 14 of the respective member 10. The edges of each insert which oppose each other when the insert is fitted are rounded as viewed in axial section. The inserts 50, besides affording a finished appearance, also serve as bearing members for the connecting links 46 and, furthermore, serve to limit axial movement of the spacers 41.

The arrangement described with reference to the drawings besides being economical to manufacture and assemble, is neat in appearance and furthermore allows adjoining panels to be disconnected from one another or additional panels to be connected with a series of panels without difficulty and without special tools.

I claim:

1. An adjustable structure comprising two members each having ribs and grooves interengaging with one another after the fashion of gear teeth so that the members can roll relative to one another about respective axes, each said member carrying a resilient spindle element disposed substantially coaxially with the respective said member and resiliently displaceable, at least in part, transversely of said axis, said members being held together by at least one connecting element providing openings or recesses receiving respective said resilient spindle elements of the two members, the configuration of the connecting element and/or the spindle elements being such that resilient displacement of said spindle elements transversely of said axes, towards one another is necessary to apply the connecting element to or detach it from said spindle elements.

2. A structure according to claim 1 wherein said connection means incorporates fixing elements with enlarged heads carried by each said panel and which heads are engaged in slots of complementary cross section in the respective members.

3. A structure according to claim 1 wherein each said member having ribs and grooves has an axial passage therethrough within which the respective spindle element is supported with clearance, said connecting element passing through a respective circumferential gap in the surface of each said member to engage, by means of a respective one of two hook formations which are provided at opposite ends of the connecting element, around the respective spindle element.

4. A structure according to claim 2 wherein each said spindle element is in the form of a resiliently flexible spindle which is supported in the respective said passage by supporting and spacing members spaced apart axially on opposite sides of the respective said gap so as to allow said transverse displacement of the portion of the spindle which is in the region of said gap and is engaged by said connecting element.

5. A structure according to claim 3 or 4 wherein each said member is formed as an extrusion of substantially constant cross-section, having a portion for engagement with a panel.

6. A structure according to claim 4 wherein each said member comprises, in combination, an extrusion of substantially constant cross-section having a portion for engagement with a panel, and a further extrusion, of substantially constant cross-section, affording said gear teeth, said extrusions having complementary interengageable retaining formations whereby said further extrusion may be retained on the first-mentioned extrusion.

7. A structure according to claim 5 wherein each said member is secured to a panel edge by connection means including a formation afforded by said extrusion having said portion for engagement with a panel.

* * * * *